US010153117B2

(12) United States Patent
Guignot et al.

(10) Patent No.: US 10,153,117 B2
(45) Date of Patent: Dec. 11, 2018

(54) ELECTROMAGNETIC POWER CONTACTOR PROVIDED WITH CONTROL ROD HAVING STOP

(71) Applicant: VALEO EQUIPEMENTS ELECTRIQUES MOTEUR, Creteil (FR)

(72) Inventors: Romain Guignot, St Victor de Cessieu (FR); Christophe Patroix, Chatonnay (FR)

(73) Assignee: Valeo Equipements Electriques Moteur, Creteil (FR)

( * ) Notice: Subject to any disclaimer, the term of this patent is extended or adjusted under 35 U.S.C. 154(b) by 0 days.

(21) Appl. No.: 15/500,693

(22) PCT Filed: Jul. 30, 2015

(86) PCT No.: PCT/FR2015/052117
§ 371 (c)(1),
(2) Date: Jan. 31, 2017

(87) PCT Pub. No.: WO2016/016585
PCT Pub. Date: Feb. 4, 2016

(65) Prior Publication Data

US 2017/0221665 A1 Aug. 3, 2017

(30) Foreign Application Priority Data

Aug. 1, 2014 (FR) ..... 14 57503

(51) Int. Cl.
*H01H 3/00* (2006.01)
*H01H 51/06* (2006.01)
(Continued)

(52) U.S. Cl.
CPC ..... *H01H 51/065* (2013.01); *H01H 50/12* (2013.01); *H01H 50/14* (2013.01);
(Continued)

(58) Field of Classification Search
CPC ..... H01H 50/54; H01H 50/64; H01H 65/00; H01H 65/02; H01H 65/04; H01H 67/02; H01H 51/065
(Continued)

(56) References Cited

U.S. PATENT DOCUMENTS 3,815,060 A * 6/1974 Turnbull ..... H01H 50/546 335/131
4,404,533 A 9/1983 Kurihara et al.
4,604,597 A * 8/1986 Bogner ..... H01H 51/065 335/127
(Continued)

FOREIGN PATENT DOCUMENTS

DE 102010040269 A1 4/2011
EP 0960276 A1 12/1999
(Continued)

*Primary Examiner* — Shawki S Ismail
*Assistant Examiner* — Lisa Homza
(74) *Attorney, Agent, or Firm* — Berenato & White, LLC

(57) ABSTRACT

The invention relates to an electromagnetic contactor including: —first and second magnetic cores, the second core being mobile relative to the first core; —a control rod mobile between an inoperative position and a supply position, the control rod comprising a shoulder, in inoperative position: —the shoulder comprises one surface in contact with the first magnetic core, —the first magnetic core and the control rod separating a first chamber extending between the first and second magnetic cores and a second chamber in which the contact plate is located, and —at least one opening made between the first chamber and the second chamber allowing the transfer of air from the first chamber to the second chamber when the second magnetic core moves from the inoperative position to the magnetized position.

11 Claims, 5 Drawing Sheets

(51) Int. Cl.

| | |
|---|---|
| ***H01H 50/12*** | (2006.01) |
| ***H01H 50/14*** | (2006.01) |
| ***H01H 50/56*** | (2006.01) |
| *H01H 9/04* | (2006.01) |
| *H01H 13/82* | (2006.01) |

(52) U.S. Cl.
CPC ..... *H01H 50/56* (2013.01); *H01H 9/047* (2013.01); *H01H 13/82* (2013.01); *H01H 2235/01* (2013.01)

(58) Field of Classification Search
USPC ..... 335/189
See application file for complete search history.

(56) References Cited

U.S. PATENT DOCUMENTS 5,424,700 A * 6/1995 Santarelli ..... H01H 1/06 335/126
5,892,422 A * 4/1999 Montaigu ..... H01H 51/065 335/126
6,049,263 A * 4/2000 Vilou ..... H01H 51/065 290/38 R
6,323,562 B1 11/2001 Renner et al.
7,199,687 B2 * 4/2007 Maruhashi ..... F02N 15/063 335/131
8,928,436 B2 * 1/2015 Hirabayashi ..... H01H 51/065 335/131
9,070,525 B2 6/2015 Hirabayashi
9,177,744 B2 * 11/2015 Biessenberger ..... H01H 51/065

FOREIGN PATENT DOCUMENTS

FR 2795884 A1 1/2001
FR 2843427 A1 2/2004
FR 2994504 2/2014
FR 3000288 A1 6/2014

* cited by examiner

ELECTROMAGNETIC POWER CONTACTOR PROVIDED WITH CONTROL ROD HAVING STOP

CROSS-REFERENCE TO RELATED APPLICATIONS AND CLAIM TO PRIORITY

This application is a national stage application of International Application No. PCT/FR2015/052117 filed Jul. 30, 2015, which claims priority to French Patent Application No. 1457503 filed Aug. 1, 2014, the disclosures of which are incorporated herein by reference and to which priority is claimed.

FIELD OF THE INVENTION

The invention relates to an electromagnetic power contactor provided with a control rod with a stop.

The present invention has a particularly advantageous application in the field of electromagnetic contactors for power circuits, in particular for an electric motor of a starter of an internal combustion engine, in particular for a motor vehicle.

In particular, the invention is implemented with the starters used with vehicles which are equipped with the function of automatic stopping and restarting of the thermal engine (so-called stop and start function).

BACKGROUND OF THE INVENTION

In a known manner, a contactor has two roles, firstly to displace the launcher which supports the pinion of the starter by means of a pivoting lever, such as to allow the pinion to engage on the ring of the thermal engine to be started, and secondly to supply the electric motor of the starter, making it possible to rotate the pinion.

For this purpose, as shown in FIG. 1, the contactor 1 is provided with a fixed core 2, a mobile core 3, and a metal housing 5 in which there is provided a set of coils 6*a*, 6*b* fitted on an insulating annular support 9.

An end of the mobile core 3 is connected to the pivoting lever 10. The other end of the mobile core 3 is designed to act on the rear end of a control rod 13 by thrusting through a central bore 16 in the fixed core 2, in which the rear part of the rod 13 is fitted such as to slide.

The control rod 13 supports a contact plate 17, which is fitted such as to slide on the control rod 13. The contact plate 17 extends transversely, in order to be able to cooperate with two electrical terminals 18, 19 of an electric power circuit and establish electrical contact between them.

The control rod 13 supports a compression spring 21 which is provided between a shoulder 131 and the contact plate 17. The contactor 1 also comprises a return spring 22, provided between the cover 25 and a stop 132 of the control rod 13.

The mobile core 3 is mobile between a position, known as the position of rest, in which the mobile core 3 is in a position spaced from the fixed core 2, and a position, known as the magnetised position, in which the mobile core 3 is in contact with the fixed core 2 further to the activation of the set of coils 6*a*, 6*b*, thus generating a magnetic field for attraction of the mobile core 3 towards the fixed core 2.

In addition, the control rod 13, displaced by the mobile core 3, is mobile between a position of rest and a supply position, in which the contact plate 17 establishes contact with the electrical terminals 18, 19 when the mobile core 3 is in the magnetised position.

In order to increase the service life of the contactor 1 for applications of the stop and start type in which the starter is in heavy use, document FR2994504 teaches the use of a contactor 1 provided with a control rod 13 comprising a shoulder 131 which abuts the fixed core 2 when the rod 13 is in the position of rest. The stresses are thus distributed on the rod 13, and not on the contact plate 17, as is the case with other types of devices.

The problem of a configuration of this type is that the shoulder 131 shuts off the flow of air generated by the displacement of the mobile core 3, which leads to slowing down of the speed of displacement of the core 3, from the position of rest to the magnetised position. FIG. 2 thus shows that at the moment of establishment of the contact of the contact plate 17 with the terminals 18, 19, the speed of the mobile core 3 at the end of the course is approximately 0.8 m/s (cf. point O1). However a speed of this type is not sufficient to break the ice which may have formed on the electrical terminals 18, 19 in the case of low temperature.

SUMMARY OF THE INVENTION

The objective of the invention is to eliminate this disadvantage efficiently by proposing an electromagnetic power contactor, in particular for an electric motor of a starter of an internal combustion engine, comprising:

a first magnetic core;

a second magnetic core which is mobile relative to the said first magnetic core, the said second core being mobile between a position of rest and a magnetised position, in which the said second magnetic core is in contact with the said first magnetic core;

a control rod which is mobile between a position of rest and a supply position;

a contact plate which is fitted on the said control rod, and can establish contact with electrical terminals when the said control rod is in the supply position, wherein the said control rod comprises a shoulder, and, in the position of rest, the said shoulder comprises a face which is in contact with the said first magnetic core, the said first magnetic core and the said control rod in the position of rest separating a first chamber, which extends between the first and the second magnetic cores, and a second chamber in which the said contact plate is situated; and at least one opening formed between the said first chamber and the said second chamber, which permits the transfer of air from the said first chamber to the said second chamber when the said second magnetic core is displaced from the position of rest to the magnetised position.

The formation of an opening of this type makes it possible to increase the speed of displacement of the mobile core, and thus the contact plate, which assists the breaking of the ice which may have formed on the electrical terminals in the case of low temperatures.

According to one embodiment, the said opening is formed in an area of contact between the said first magnetic core and the face of the said shoulder, when the said control rod is in the position of rest.

According to one embodiment, at least one vent is formed in the face of the said shoulder.

According to one embodiment, two vents are formed in the face of the said shoulder.

According to one embodiment, three vents are formed in the face of the said shoulder.

According to one embodiment, the said opening has an air inlet formed in a radial face of the said control rod situated in the said first chamber.

According to one embodiment, the said opening has an air outlet formed in a radial face of the said control rod situated in the said second chamber.

According to one embodiment, the said opening has an air outlet formed in an outer periphery of the said control rod.

According to one embodiment, the said opening is formed in the said first magnetic core.

According to one embodiment, the said opening has dimensions such that the speed of the said second magnetic core is contained between 0.9 and 1.1 m/s.

According to one embodiment, the said electrical terminals have surfaces of contact with the said contact plate, which surfaces are provided with pins.

According to one embodiment, the said contact plate is kept supported against a stop by a compression spring positioned between the said shoulder and the said stop.

According to one embodiment, the stop is constituted by a washer which is immobilised axially by claws which can be anchored in the said control rod.

According to one embodiment, the said stop is constituted by a collar which is integral with the control rod, with an added-on closure clip having a radial notch which receives a portion of the said control rod and abuts the said shoulder of the said control rod.

According to one embodiment, with a return spring being arranged between a cover and the said stop, a force of the said compression spring on the said contact plate is at least 20 Newtons more than a force of the said return spring on the said control rod in the active position. This therefore limits the rebounds of the plate during the activation of the contactor.

BRIEF DESCRIPTION OF THE DRAWINGS

The invention will be better understood by reading the following description and examining the figures which accompany it. These figures are provided purely by way of illustration, but in no way limit the invention.

DETAILED DESCRIPTION OF THE PREFERRED EMBODIMENT(S)

In the following description the relative terms "rear" and "front" correspond to an orientation from left to right in FIG. 3, with a rear portion of a part being situated on the left-hand side and a front portion of a part being situated on the right-hand side.

Figure 1:
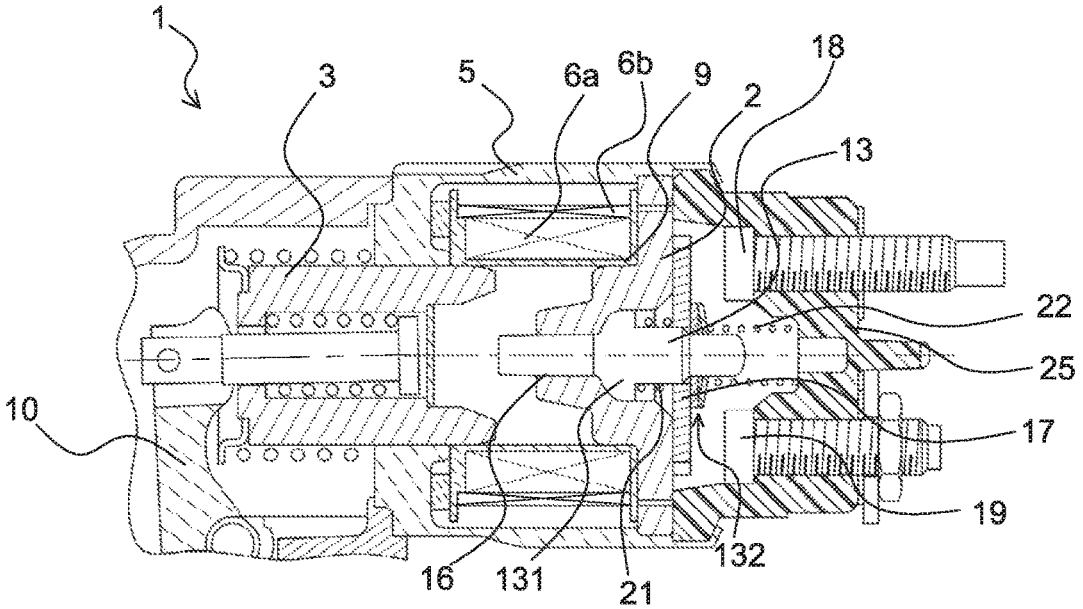
Fig. 1 PRIOR ART
FIG. 1, already described, represents a view in longitudinal cross-section of an electromagnetic contactor according to the prior art in the state of rest.
Figure 2:
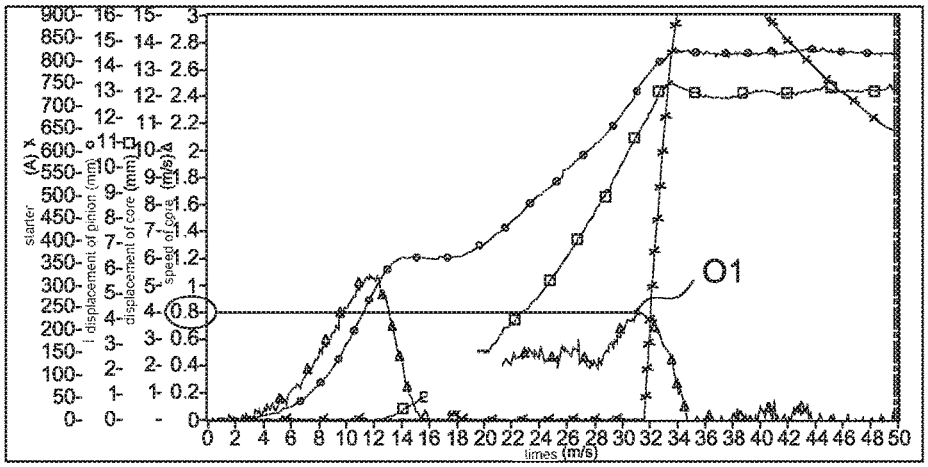
Fig. 2 PRIOR ART
FIG. 2, already described, shows the development over a period of time of different parameters of the contactor in FIG. 1 during its passage from a state of rest to an activated position.
Figure 3:
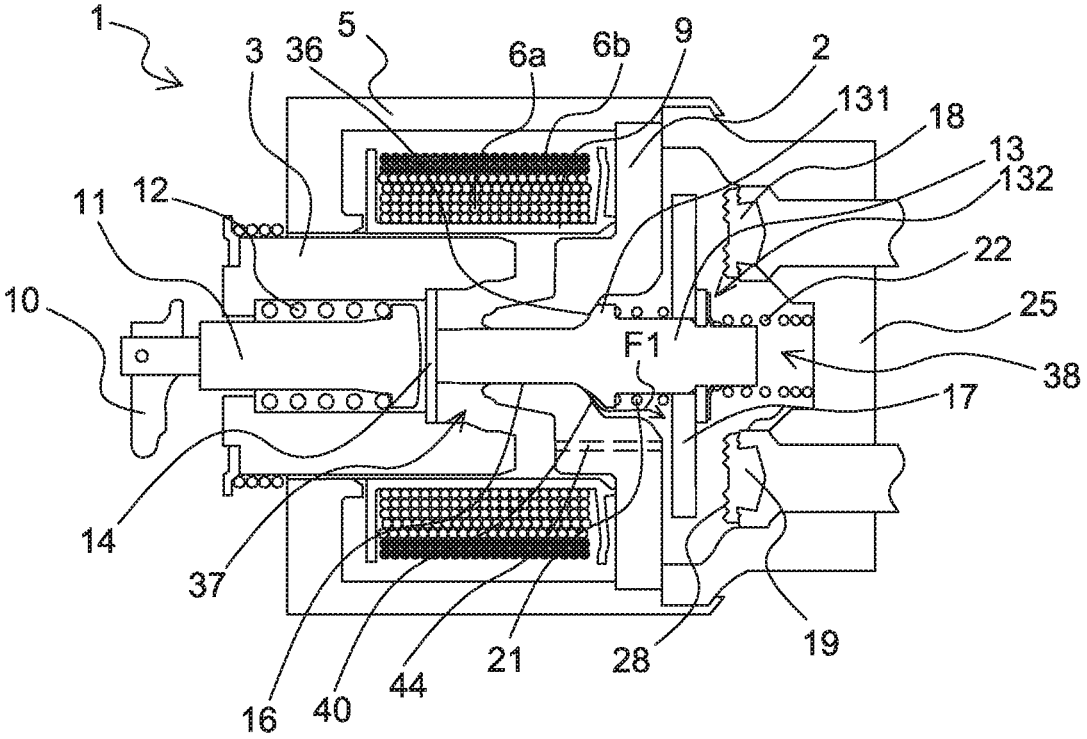
FIG. 3 is a view in longitudinal cross-section of an electromagnetic contactor according to the present invention in the state of rest.

FIG. 3 illustrates a contactor 1 fitted in the place of, and instead of, the contactor in FIG. 1. This contactor 1 is used for example in order to control the activation of an electric motor of a starter of an internal combustion engine. The contactor 1 is provided with a fixed core 2, a mobile core 3, both made of ferromagnetic material, and a metal housing 5 in which a set of coils 6*a*, 6*b* is arranged, fitted on an insulating annular support 9.

The mobile core 3 can be displaced between a position of rest, represented in FIG. 3, in which the mobile core 3 is in a position spaced from the fixed core 2, and a magnetised position, in which the mobile core 3 comes into contact with the fixed core 2.

For this purpose, the set of coils 6*a*, 6*b* comprises a pull-in coil 6*a* and a contact coil 6*b*. The two coils 6*a*, 6*b* are supplied with power in order to displace the mobile core 3 from its position of rest to its magnetised position, then the retention of the core 3 in the magnetised position is ensured solely by the contact coil 6*b*, such as to limit the consumption of the set of coils.

A rear end of the mobile core 3 is connected, via a connection rod 11, to a pivoting lever 10 (represented partially), which drives the displacement of a pinion launcher (not represented) of the starter to the starter ring of the thermal engine to be started, when the mobile core 3 is displaced to its magnetised position. A tooth-against-tooth spring 12 is compressed in the case of non-direct penetration of the pinion of the launcher (not represented) in the starter ring. The connection rod 11 and the spring 12 are fitted inside a cavity made of electrically insulating material. This cavity is closed by the front end of the mobile core 3 constituted by a washer 14.

In addition, the displacement of the mobile core 3 into the magnetised position gives rise to the displacement in translation relative to the housing 5 of a control rod 13, between a position of rest and a supply position. For this purpose, the front end of the mobile core 3 acts on the control rod 13, by thrusting the rear end of the rod 13 through a central bore 16 in the fixed core 2 in which the rod 13 is fitted such as to slide.

This control rod 13 is provided with a shoulder 131 and a stop 132 which is integral in translation with the control rod 13. A contact plate 17 is fitted on the control rod 13. The passage into the supply position of the control rod 13 gives rise to putting into contact of the contact plate 17 with the electrical terminals 18, 19, in order to supply the electric motor (not represented) thus giving rise to the rotation of the pinion.

The contact plate 17, which is formed from an electrically conductive material, is thus mobile relative to the control rod 13, between an initial position in which the control rod 13 is in a position of rest, and a final position, in which the control rod 13 is in the active position. In the initial position, the contact plate 17 is supported against the stop 132, and in the final position, a gap is formed between the stop 132 and the contact plate 17, because of the contact with the electrical terminals 18, 19.

The two terminals 18, 19 are fixed, and are supported by a cover 25 made of electrically insulating material, which is secured by crimping in a front part of the housing 5. One of the terminals 18 is designed to be connected to the positive terminal of the battery, whereas the other terminal 19 is designed to be connected to the electric motor of the starter, as described for example in the aforementioned document FR2795884. Preferably, the electrical terminals 18, 19 have surfaces of contact with the contact plate 17 which are provided with pins 28 in order to facilitate the breaking of the ice which may have formed on the terminals in the case of low temperatures.

A compression spring 21, which is fitted on the control rod 13, is designed to keep the contact plate 17 supported on the stop 132, when the contact plate 17 is not in contact with the electrical terminals 18, 19, and to be compressed when the contact plate 17 comes into contact with the electrical terminals 18, 19. For this purpose, the pre-stressed compression spring 21 is provided between the shoulder 131 and the contact plate 17.

In addition, a return spring 22 is designed to facilitate the return of the control rod 13 to the position of rest when the coils 6*a*, 6*b* are no longer supplied with power. For this purpose, the return spring 22 is provided between the cover 25 and the stop 132, in order to return the rod 13 and the contact plate 17, such that a front part of the rod 13 is partly positioned inside the spring 22.

The springs 21, 22 are helical springs with a cylindrical form. The return spring 22 has rigidity which is lower than that of the compression spring 21. Preferably, in order to limit the rebounds of the plate 17 during the activation of the contactor 1, the force of the compression spring 21 on the contact plate 17 in the final position is at least 20 Newtons more than the force of the return spring 22 on the control rod 13 in the active position.

Figure 4:
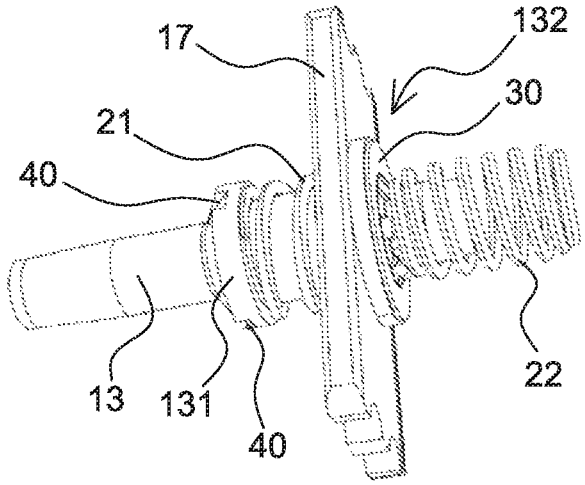
FIG. 4 is a view in perspective of the control rod and of the associated elements belonging to the contactor in FIG. 3.
Figure 5A:
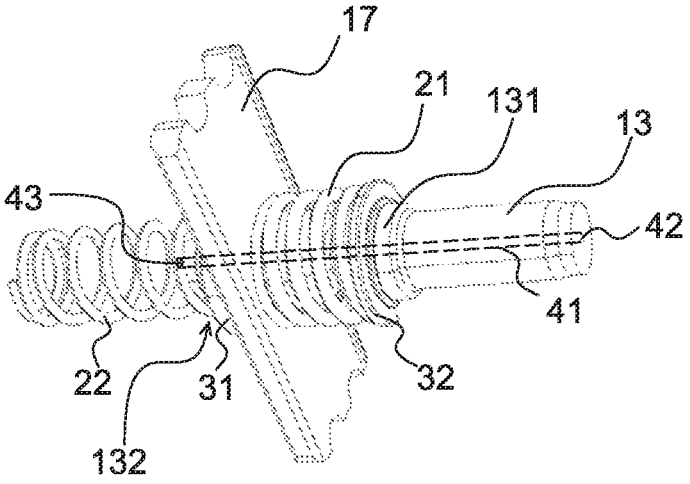
FIGS. 5*a* and 5*b* are respectively views in perspective and from the front of another embodiment of the control rod belonging to the contactor in FIG. 3.
Figure 5B:
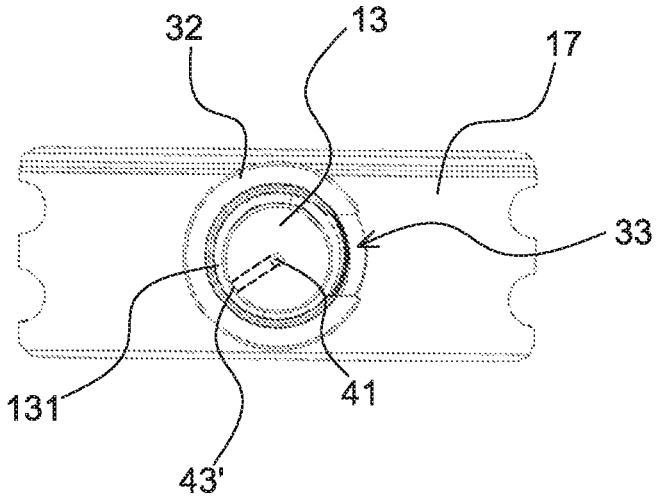
Figure 6:
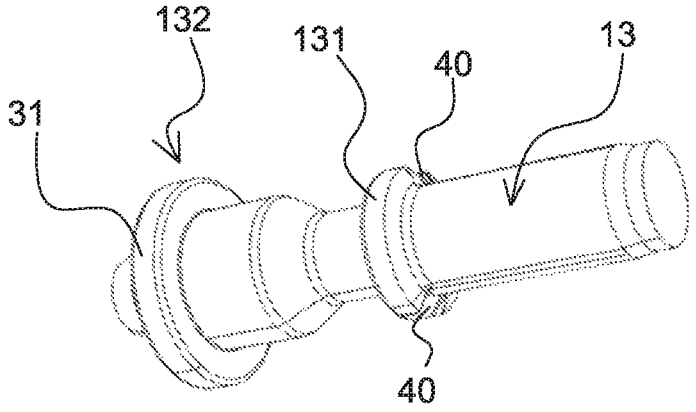
FIG. 6 shows a view in perspective of the control rod alone, provided with vents for the passage of the air.
Figure 7A:
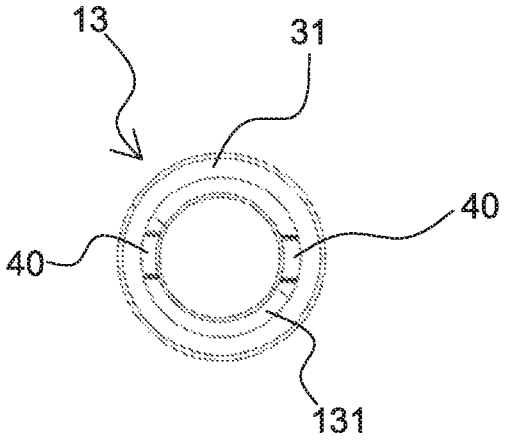
FIGS. 7*a* and 7*b* show front views of the control rod in FIG. 6 provided respectively with two and three vents.
Figure 7B:
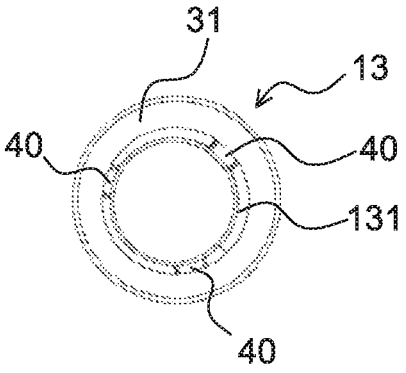

In the embodiment in FIGS. 3 and 4, the stop 132 of the control rod 13 is constituted by a washer 30, immobilised axially by claws which can be anchored in the plastic material of the rod 13. As a variant, as represented in FIGS. 5*a*, 5*b* and 6, the stop 132 is constituted by a collar 31 which is integral with the control rod 13. In this embodiment, an added-on closure clip 32 is used, with a radial width which is greater than, or equal to, the outer diameter of the compression spring 21. This closure clip 32 has a radial notch 33 which receives a portion of the control rod 13, and abuts the shoulder 131 of the rod 13. The compression spring 21 is then fitted compressed between the closure clip 32 and the contact plate 17, which abuts the collar 31.

The rod 13, as well as the shoulder 131, and if applicable the collar 31, integral with the rod 13, are made of electrically insulating plastic material, in order to avoid any short-circuiting with the contact plate 17. The rod 13 is thus for example formed from insulating plastic material, optionally reinforced by fibres. It is for example made of PA 6-6, and is obtained by moulding. As a variant, the rod 13 is made of ceramic, and is obtained for example by sintering.

When the control rod 13 is in the position of rest, the shoulder 131 comprises a face which is in contact with the fixed core 2, in a contact area 36 which can be seen in FIG. 3. This contact area 36, which in this case has a frusto-conical form, makes it possible to distribute in an optimum manner the forces sustained by the control rod 13 during its return to the position of rest. The configuration of the rod 13 is such that, when the control rod 13 is in the position of rest, a gap of approximately a millimeter exists between the contact plate 17 and the fixed core 2.

In the position of rest, the fixed core 2 and the control rod 13 separate a first chamber 37 and a second chamber 38. The first chamber 37 extends between the mobile core 3 and the fixed core 2, and is also delimited by an inner periphery of the insulating annular support 9. The second chamber 38, which extends between the cover 25 and the fixed core 2, corresponds to the contact chamber for the terminals 18, 19 and the contact plate 17.

According to the invention, an opening is formed between the first chamber 37 and the second chamber 38, in order to permit the transfer of air from the first chamber 37 to the second chamber 38, when the mobile core 3 is displaced from the position of rest to the magnetised position, i.e., during displacement of the mobile core 3 from the position of rest to the magnetised position thereof.

Thus, in the embodiments in FIGS. 3, 4, 6, 7*a* and 7*b*, at least one vent 40 is formed in the face of the shoulder 131 which is in contact with the fixed core 2 when the rod 13 is in the position of rest. More specifically, in the embodiment in FIGS. 6 and 7*a*, two diametrically opposite vents 40 are formed in the shoulder 131. In the embodiment in FIG. 7*b*, three vents which are spaced angularly regularly from one another are formed in the shoulder 131.

As shown in FIG. 3, the air obtained from the first chamber 37 can then pass according to the arrow F1 along the rod 13, between the wall which delimits the bore 16 in the fixed core 2, and the control rod 13, because of the gap which exists structurally between these two elements, in order then to pass via the vents 40 so as to reach the second chamber 38.

As a variant, the vents 40 can be formed in the area of contact 36, in the part of the fixed core 2 which is in contact with the shoulder 131 of the control rod 13.

In the embodiment in FIGS. 5*a* and 5*b*, an opening 41 is formed which passes axially from one side of the control rod 13 to the other. There is then an air inlet 42 formed in a radial face of the control rod 13 situated in the first chamber 37, and an air outlet 43 formed in a radial face of the control rod 13 situated in the second chamber 38. The air can thus pass through the rod 13, in order to go from the first chamber 37 via the air inlet 42, to the second chamber 38 via the air outlet 43.

Alternatively, as represented in discontinuous lines in FIG. 5*b*, the opening 41 has an air outlet 43' which is situated in the second chamber 38, and opens into a periphery of the control rod 13. The opening 41 then comprises an axial portion, as well as a radial portion in the form of a duct, which extends between the outer periphery of the rod 13 and the axial portion of the opening.

As a variant, as shown in FIG. 3, a through opening 44 is formed, represented in discontinuous lines in the fixed core 2, in order to put the first 37 and the second 38 chambers into communication.

Figure 8:
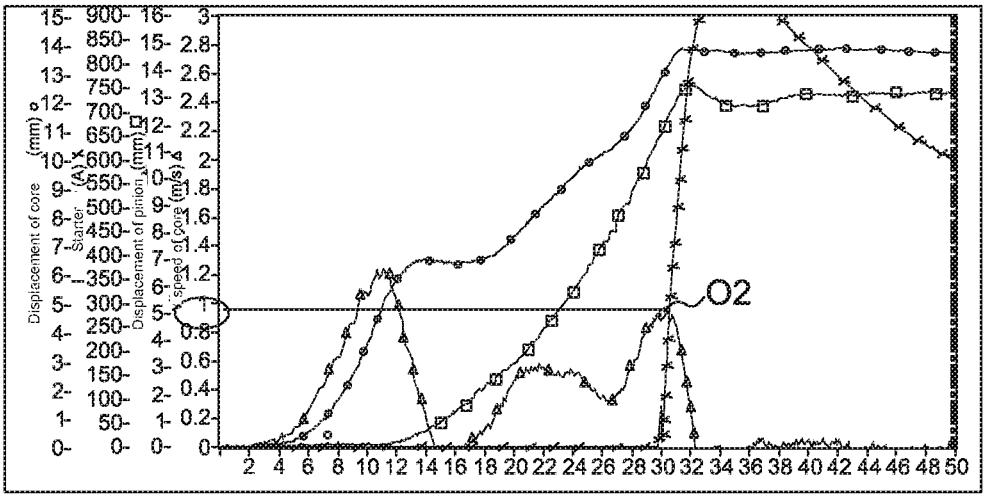
FIG. 8 shows the development over a period of time of different parameters of the contactor in FIG. 3 during its passage from a state of rest to an activated position.

As described previously, in operation, the power supply of the set of coils 6*a*, 6*b* gives rise to the displacement of the control rod 13 to the supply position, thus giving rise to putting into contact of the contact plate 17 with the electrical terminals 18, 19. At this instant, the compression spring 21 applies a force on the contact plate 17 which is at least 20 Newtons more than the force exerted by the return spring 22 on the control rod 13, because of the difference in rigidity between the compression spring 21 and the return spring 22. This force of the compression spring 21 which is greater than that of the return spring 22 makes it possible to limit the gap formed between the contact plate 17 and the stop 132 in the final position of the contact plate 17, i.e. at the moment of the contact with the electrical terminals 18, 19. The rebound which is sustained by the contact plate 17 is thus reduced during the passage to the active position of the control rod 13, such that the power supply of the electric motor is created without any false contacts (cf. curve of the intensity which passes through the starter (I starter) represented by crosses in FIG. 8).

Figure 9:
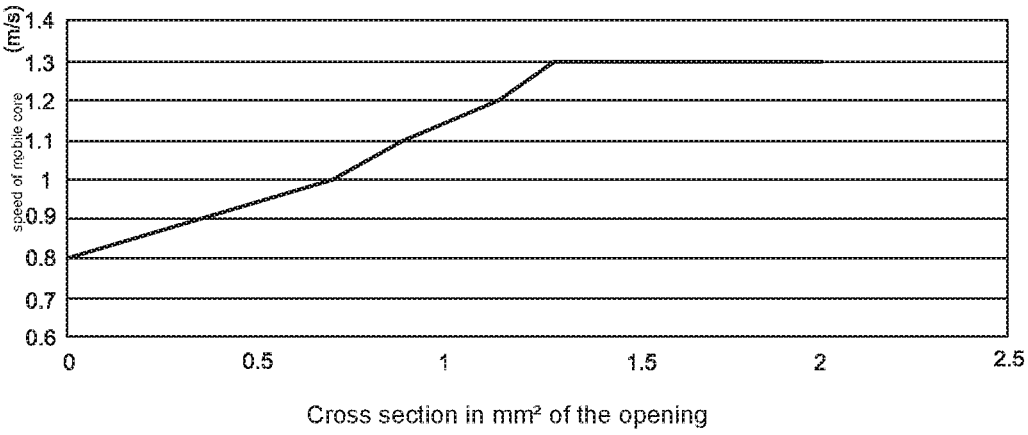
FIG. 9 shows the development of the speed of the mobile core according to the cross-section of the opening which permits the passage of the air between the first and the second chambers of the contactor according to the present invention.

In addition, the fact that the air can go from the first chamber 37 to the second chamber 38 makes it possible to increase the speed of displacement of the plate 17, which assists the breaking of the ice which may have formed on the terminals 18, 19 in the case of low temperatures. In this case, the speed of the mobile core 3 is approximately 0.9 m/s when the plate 17 reaches the final position against the terminals 18, 19 (cf. point O2). As can be seen in FIG. 9, it is possible to adapt the speed of displacement of the mobile core 3, and thus of the plate 17, according to the cross-section of passage of the opening. Preferably, the openings 40, 41, 44 are formed such that the speed of the mobile core 3 is contained between 0.9 and 1.1 m/s.

In addition, when the coils 6*a*, 6*b* are no longer supplied with power, the mobile core 3 is no longer attracted to the fixed core 2, which gives rise to a return of the mobile core 3 to the position of rest. The return spring 22 makes it possible to disconnect the contact plate 17 from the electrical terminals 18, 19, such as to permit the return of the control rod 13 to the position of rest. The shoulder 131 then comes back into contact with the fixed core 2.

The compression spring 21 is also decompressed, such that the contact plate 17 goes from its final position to its initial position, in which it is supported once more against the stop 132.

Alternatively, the fixed core 2 is replaced by a core for closure of the flow which is at least partly mobile relative to the housing 5 of the starter.

The invention applies to all types of contactors 1 for the electric motors of the conventional starters of internal combustion engines. Thus, the contactor 1 can be implanted above the electric motor of the starter, as in document FR2795884. As a variant, the contactor 1 is offset, and is for example implanted transversely at the rear of the electric motor of the starter, as in document FR2843427.

The tooth-against-tooth spring which is compressed in the case of non-direct penetration of the pinion of the launcher in the starter ring is implanted either in the contactor 1, as in FIG. 3, or on the exterior of the contactor 1, between the launcher and the activation lever, as in FIG. 1 of document EP0960276.

As a variant, the contactor 1 comprises only one coil, as described in document FR2795884.

As a variant, a specific electric motor is provided in order to activate the lever, such that the mobile core 3 is simplified by being without means for connection with the lever.

It will be appreciated that the foregoing description has been provided purely by way of example, and does not limit the field of the invention, a departure from which would not be constituted by replacing the details of execution by any other equivalents.

The invention claimed is:

1. An electromagnetic power contactor (1) for an electric motor of a starter of an internal combustion engine, comprising:

a first magnetic core (2);

a second magnetic core (3) which is mobile relative to said first magnetic core (2), said second magnetic (3) core being mobile between a position of rest and a magnetised position, in which said second magnetic core (3) is in contact with said first magnetic core (2);

a control rod (13) which is mobile between a position of rest and a supply position;

a contact plate (17) which is fitted on said control rod (13) and configured to establish contact with electrical terminals (18, 19) when said control rod (13) is in said supply position, said first magnetic core (2) and said control rod (13) in said position of rest separating a first chamber (37) extending between said first magnetic core (2) and said second (3) magnetic core and a second chamber (38) in which said contact plate (17) is situated; and at least one opening (40, 41, 44) formed between said first chamber (37) and said second chamber (38), which permits the transfer of air from said first chamber (37) to said second chamber (38) during displacement of said second magnetic core (3) from said position of rest to said magnetised position;

said control rod (13) comprises a shoulder (131), said shoulder (131) comprises a face which is in contact with said first magnetic core (2) in the position of rest of said control rod (13);

said at least one opening formed in an area of contact (36) between said first magnetic core (2) and the face of said shoulder (131), when said control rod (13) is in the position of rest;

at least one vent (40) is formed in said face of said shoulder (131).

2. The electromagnetic power contactor according to claim 1, wherein two vents (40) are formed in said face of said shoulder (131).

3. The electromagnetic power contactor according to claim 2, wherein said at least one opening (40, 41, 44) has dimensions such that a speed of said second magnetic core (3) is contained between 0.9 and 1.1 m/s.

4. The electromagnetic power contactor according to claim 1, wherein three vents (40) are formed in said face of said shoulder (131).

5. The electromagnetic power contactor according to claim 4, wherein said at least one opening (40, 41, 44) has dimensions such that a speed of said second magnetic core (3) is contained between 0.9 and 1.1 m/s.

6. The electromagnetic power contactor according to claim 1, wherein said at least one opening (40, 41, 44) has dimensions such that a speed of said second magnetic core (3) is contained between 0.9 and 1.1 m/s.

7. An electromagnetic power contactor (1) for an electric motor of a starter of an internal combustion engine, comprising:

a first magnetic core (2);

a second magnetic core (3) which is mobile relative to said first magnetic core (2), said second magnetic (3) core being mobile between a position of rest and a magnetised position in which said second magnetic core (3) is in contact with said first magnetic core (2);

a control rod (13) which is mobile between a position of rest position and a supply position;

a contact plate (17) which is fitted on said control rod (13) and configured to establish contact with electrical terminals (18, 19) when said control rod (13) is in said supply position, said first magnetic core (2) and said control rod (13) in said position of rest separating a first chamber (37) extending between said first magnetic core (2) and said second (3) magnetic core and a second chamber (38) in which said contact plate (17) is situated; and at least one opening (40, 41, 44) formed between said first chamber (37) and said second chamber (38), which permits the transfer of air from said first chamber (37) to said second chamber (38) during displacement of said second magnetic core (3) from said position of rest to said magnetised position thereof;

said control rod (13) comprises a shoulder (131), said shoulder (131) comprises a face which is in contact with said first magnetic core (2) in the position of rest of said control rod (13);

said at least one opening (41) has an air inlet (42) formed in a radial face of said control rod (13) situated in said first chamber (37).

8. The electromagnetic power contactor according to claim 7, wherein said at least one opening (41) has an air outlet (43) formed in a radial face of said control rod (13) situated in said second chamber (38).

9. The electromagnetic power contactor according to claim 7, wherein said at least one opening has an air outlet (43') formed in an outer periphery of said control rod (13).

10. The electromagnetic power contactor according to claim 7, wherein said at least one opening (40, 41, 44) has dimensions such that a speed of said second magnetic core (3) is contained between 0.9 and 1.1 m/s.

11. An electromagnetic power contactor (1) for an electric motor of a starter of an internal combustion engine, comprising:

a first magnetic core (2);

a second magnetic core (3) which is mobile relative to said first magnetic core (2), said second magnetic (3) core being mobile between a position of rest and a magnetised position in which said second magnetic core (3) is in contact with said first magnetic core (2);

a control rod (13) which is mobile between a position of rest and a supply position;

a contact plate (17) which is fitted on said control rod (13) and configured to establish contact with electrical terminals (18, 19) when said control rod (13) is in said supply position, said first magnetic core (2) and said control rod (13) in said position of rest separating a first chamber (37) extending between said first magnetic core (2) and said second (3) magnetic core and a second chamber (38) in which said contact plate (17) is situated; and at least one opening (40, 41, 44) formed between said first chamber (37) and said second chamber (38), which permits the transfer of air from said first chamber (37) to said second chamber (38) during displacement of said second magnetic core (3) from said position of rest to said magnetised position thereof;

said control rod (13) comprises a shoulder (131), said shoulder (131) comprises a face which is in contact with said first magnetic core (2) in the position of rest of said control rod (13);

said at least one opening (40, 41, 44) having dimensions such that a speed of said second magnetic core (3) is contained between 0.9 and 1.1 m/s.

* * * * *